US012312762B1

(12) United States Patent
Seeley

(10) Patent No.: US 12,312,762 B1
(45) Date of Patent: May 27, 2025

(54) GROUT TUBE PROTECTION SYSTEM

(71) Applicant: Theo Robert Seeley, Hacienda Heights, CA (US)

(72) Inventor: Theo Robert Seeley, Hacienda Heights, CA (US)

( * ) Notice: Subject to any disclaimer, the term of this patent is extended or adjusted under 35 U.S.C. 154(b) by 0 days.

(21) Appl. No.: 18/431,927

(22) Filed: Feb. 3, 2024

Related U.S. Application Data

(60) Provisional application No. 63/443,304, filed on Feb. 3, 2023.

(51) Int. Cl.
*E02D 5/46* (2006.01)

(52) U.S. Cl.
CPC ..... *E02D 5/46* (2013.01)

(58) Field of Classification Search
CPC ..... E02D 5/46
See application file for complete search history.

(56) References Cited

U.S. PATENT DOCUMENTS 3,324,207 A * 6/1967 Shilstone ..... B28B 23/00 264/261
2014/0314503 A1* 10/2014 Wang ..... E21D 20/028 405/302.4

FOREIGN PATENT DOCUMENTS

CN 103469792 A * 12/2013
CN 208950609 U * 6/2019 ..... E21D 11/105
CN 210684657 U * 6/2020
CN 214992766 U * 12/2021
JP H08311867 A * 11/1996

OTHER PUBLICATIONS

Machine translation of CN103469792.*

* cited by examiner

*Primary Examiner* — Janine M Kreck

(57) ABSTRACT

Grout pipes placed within a fill could be damaged by the fill as it is being placed over the pipe, the pipe needs protection until it is used. In addition, the grouting pipes needs multiple outlets to ensure that the grout flows through the voids in the fill. This patent provides a method similar burrito drainage system where filter cloth is wrapped around a drainpipe encased in gravel. This patent provides a similar design but for the opposite purpose. Where fill is placed loose and grouted after placement is complete the grout tube placed within the fill needs protection until the grouting is complete. This is done by surrounding the grout tube with granular material that will carry the load of the fill above around the pipe to ensure the integrity of the pipe and allow grout to flow out through numerous voids in the granular material.

10 Claims, 4 Drawing Sheets

GROUT TUBE PROTECTION SYSTEM

BACKGROUND AND CROSS-REFERENCE TO RELATED APPLICATIONS

Figure 1:
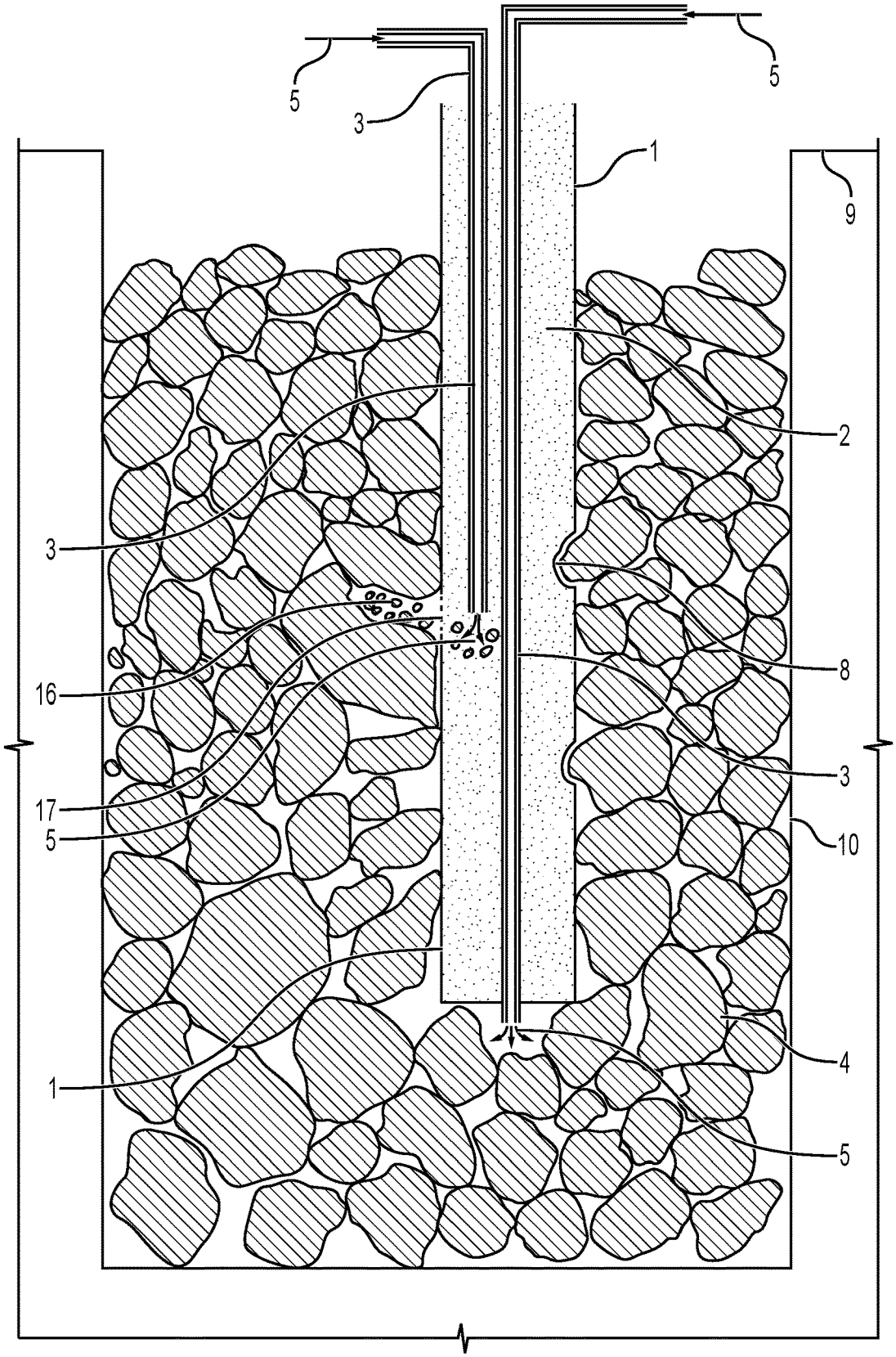

This regular patent application is a continuance of Provisional Patent Application 63/443,304 Filed on Feb. 3, 2023, by this same inventor/applicant Theo Robert Seeley P. E. with Customer Number 187666, and it was assigned Confirmation Number 4296. The subject of this patent application is the same as the referenced PPA and is using the same four Figures as submitted on Feb. 3, 2023, with only minor additions, therefore claims of this patent are based upon the first filing of the Provisional patent application. The grout tube protection system described herein is an outgrowth of this same inventor's other inventions, the Load Transfer System, patent application Ser. No. 18/364,376 which is waiting for review by a USPTO examiner, and the Green Gravity Retaining Wall patent Ser. No. 18/181,542 which reached the point of Issuance on Jan. 25, 2024. Both of these inventions are for ground stabilization and construction of retaining walls using grouted granular fill and modified steel rebar. Therefore, both will need a reliable grouting system to ensure that the fill mass has the desired properties after grouting. Therefore, this patent application claims priority to all three of these referenced patent applications.

DESCRIPTION OF PATENT AND SPECIFICATIONS

This patent provides designs for methods to inject grout into loose soil, rock, and inert debris fill. The primary problem with grout injection into loose formations is the tendency for the loose rocks or larger inert debris to shift prior to being grouted into place. This can damage the grout pipes when they are laid in or alongside the larger material. Drilling into a loose deposit of boulders and large inert debris is not a good option as it is a well-known fact that drilling into a loose boulder formation can be extremely difficult because the material will shift under the drill. It is typically more difficult to drill into a boulder formation than the parent rock formation where the boulders originated from. Therefore, if it is desired to build a fill deposit using large loose material and grouting it into place to make that fill deposit function as a consolidated deposit that will maintain its shape. Then it is preferable to place the grouting pipes in the fill as it is being deposited. This would also be true for a rock fill deposit such as described in my Green Gravity Retaining Wall system filed with the USPTO in March of 2022.

The grouting system needs three things to be efficient. First it needs to be quick and easy to construct. Second as discussed above the system needs to remain viable until the time when it is put into use. Third it needs to create numerous outlets to ensure that the grout reaches all points where it is needed to solidify the fill mass. The system proposed herein accomplishes all three of these. First it is quick and easy to lay down a thin layer of gravel to prepare a bed for the wrapping material. Then the perforated pipe is laid within a small amount of gravel and the wrapping material is folded over the perforated section of pipe which is connected to the injection pipes that extend beyond the fill zone. Then the folded wrap and the injection pipes are covered with one final layer of gravel. This is very similar to subdrain systems known as a "burrito drain" except they are used for a water outlet, and this is for grout injection.

Once constructed the fill process continues until it has reached a predetermined height without damaging the grout injection and distribution pipes. Once the grout is injected it will flow out through the numerous ports in the distribution pipe into the gravel where it can freely flow through the gravel and the wrapping material to all parts of the loosely placed fill, until the entire mass becomes one solid formation.

The following is a quick list of the four figures:

FIG. 1. Is a cut view of a vertical hole with a liner that could be porous if grout is desired at multiple elevations. The grout pipe is incased in coarse sand so that the large fill material can dent the liner but has no detrimental effect on the grout pipes.

Figure 2:
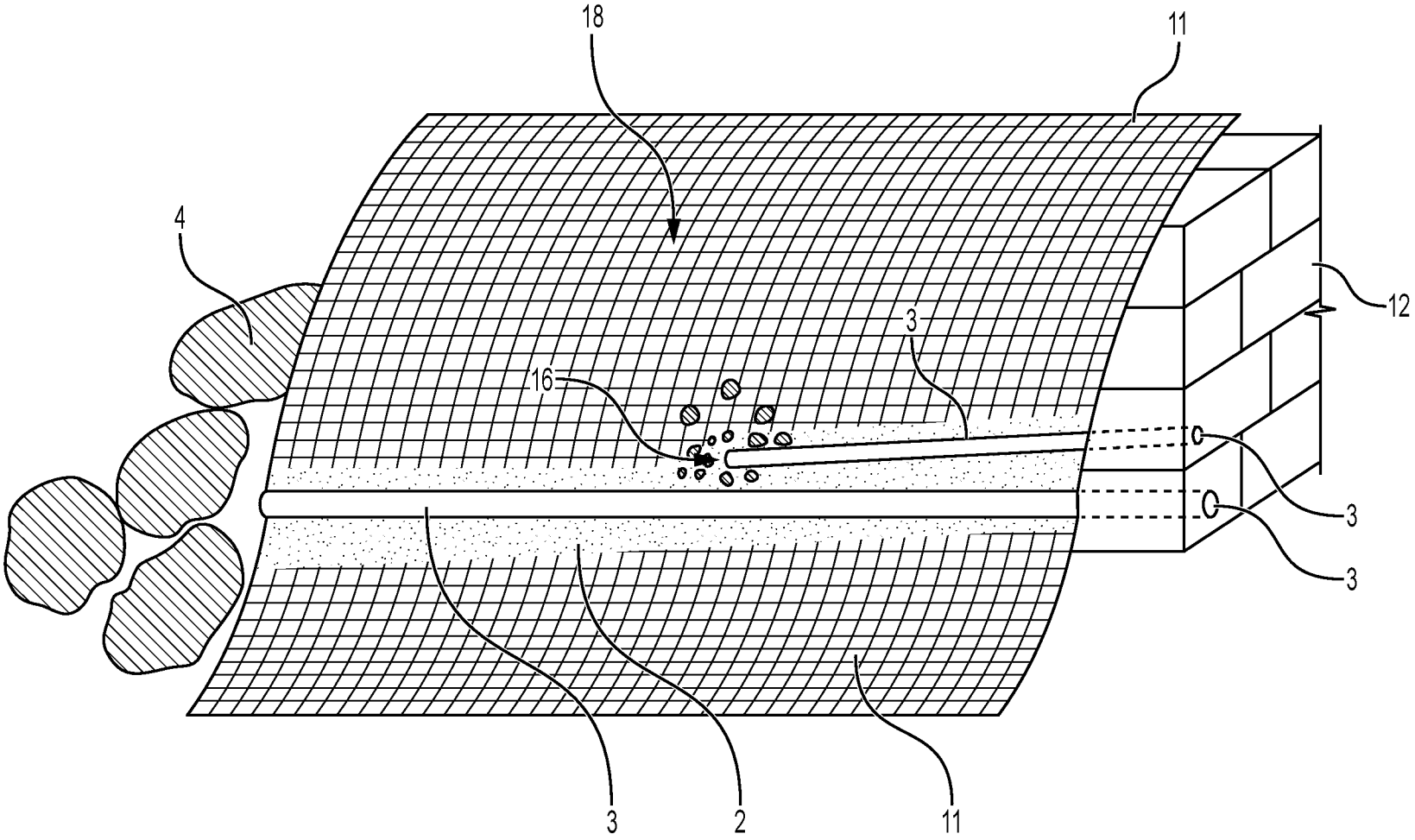

FIG. 2. Shows the first step of installing a grout distribution pipe on a bed of gravel which in turn is on top of part of the porous liner. The top portion of the liner is held back momentarily until the gravel cover is over and around the distribution pipe to protect it.

Figure 3:
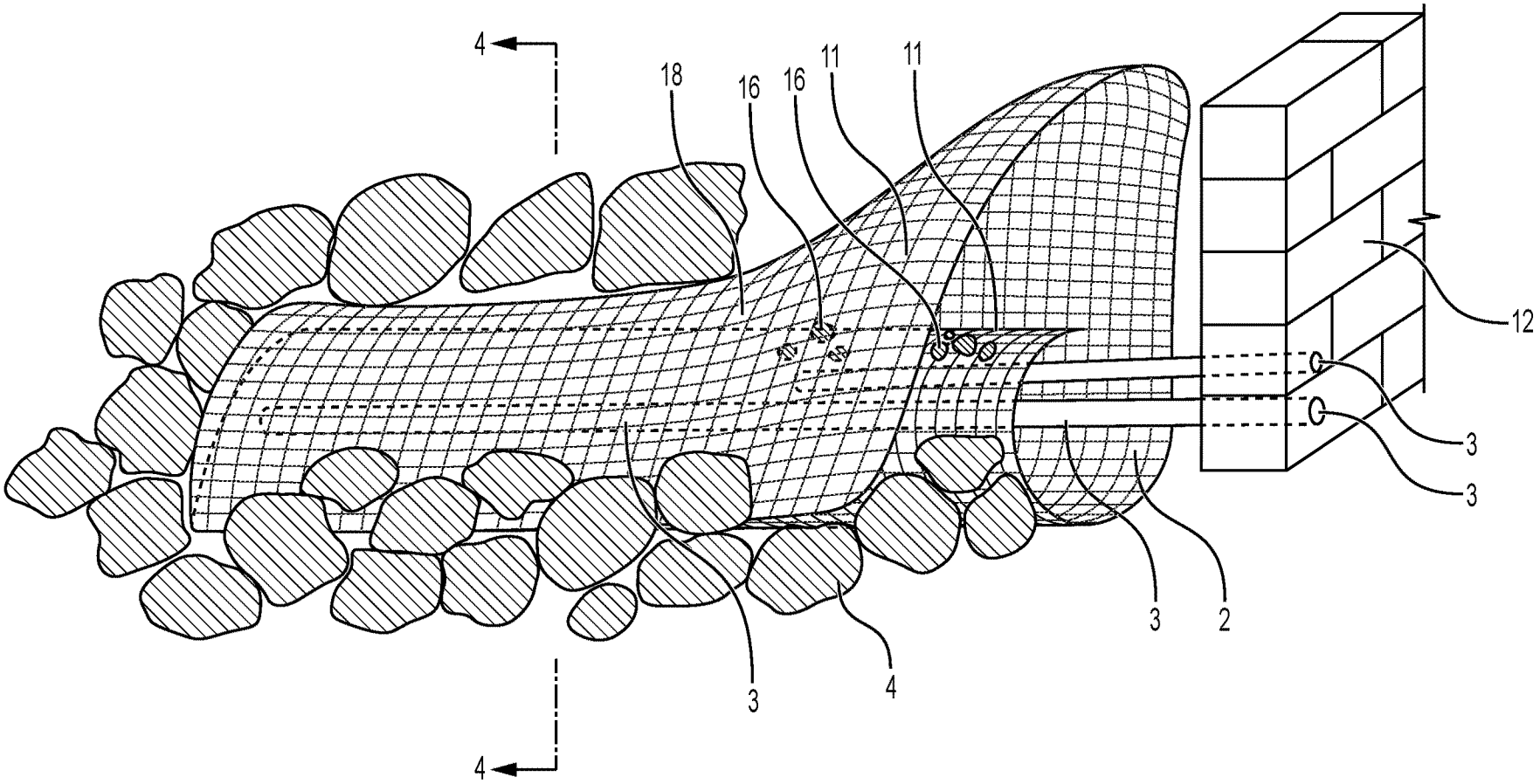

FIG. 3. Now the protection system is complete. The distribution pipe is fully encased in gravel and ready for additional large loose fill to be placed upon and around the closed liner. Also shown is the injection pipe that passes through the wall face.

Figure 4:
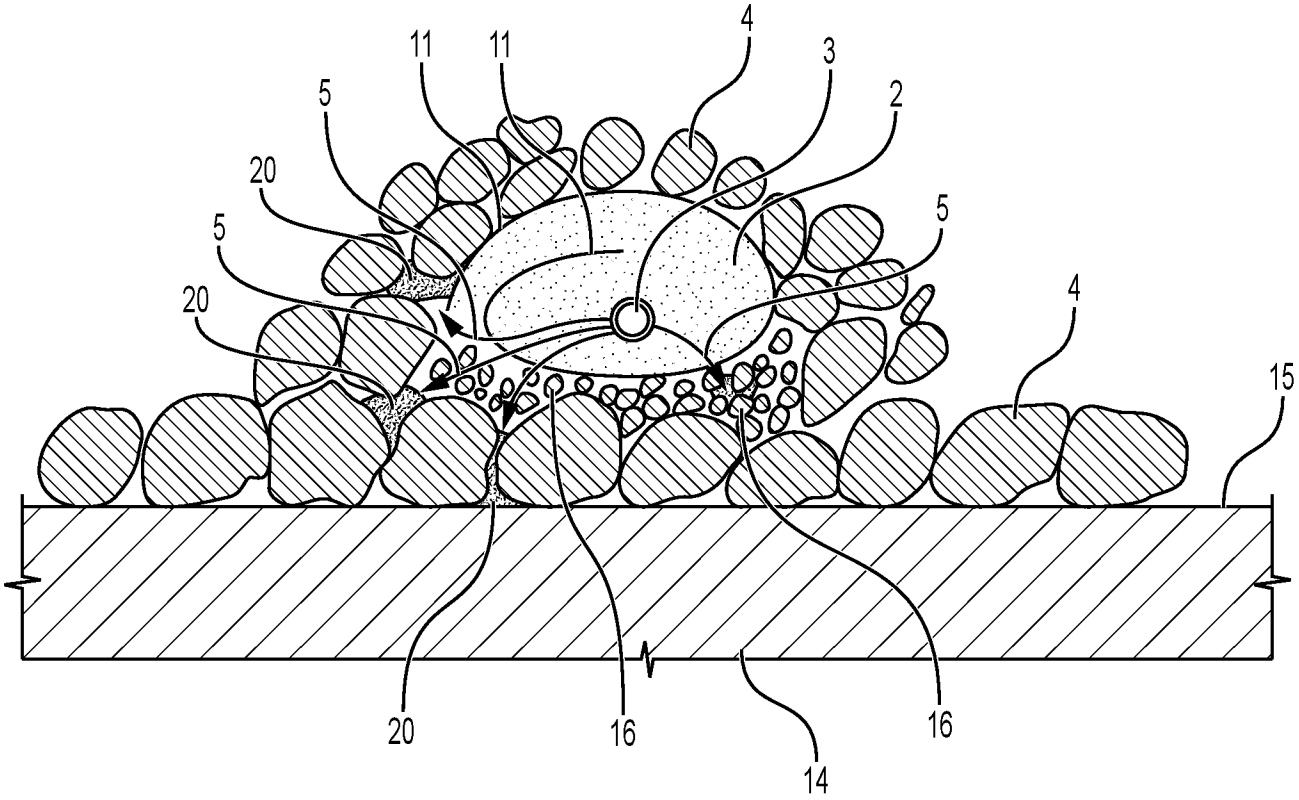

FIG. 4. Provides a cross section view of the complete system. This shows the distribution tube in the center of the wrap with gravel inside and outside the wrap. Then beyond the gravel and the wrap is a small portion of the loose large inert debris or rocks.

What is needed is a permanent confined zone of firm fine-grained material in the direction of the proposed drilling for the grout pipe. Once the deposit of rocks and other fill material is complete, then at a future time there is a path of fine-grained fill that can be drilled once or multiple times to install grout pipe(s). This can be accomplished using permanent tubes such as Sono Tubes, or plastic liners filled with fine grained dense soil or lightly cemented sand also known as Controlled Low Strength Material (CLSM). Another possibility is to install temporary metal casing which is filled with sand or CLSM when it is withdrawn from the rock fill deposit. Then the required holes can be drilled through the uniform fine grained sandy mass and the grout pipes can be installed for the grouting of the rock fill formation.

DRAWINGS

FIG. 1 Shows a cut view of the basic system where, as the rocks and large fill items 4 were placed around a protecting tube 1 which has been filled with fine-grained material such as sand 2. This filled protecting tube 1 has been installed in the middle of the rock fill. The protecting tube 1 is shown with some of the rocks 4 pushing into the sand fill 3 and denting the protective tube. Minor intrusions into the perimeter of the tube 1 and its fine-grained sand fill 2 space are shown as 8 which is a dent in the protecting tube 1. These are not a problem provided there remains a clear path for the grout injection tube 3. The grout injection tube 3 can be either installed initially along with the fill sand 2, or a hole can be drilled through the sand 2 and the grout tube 3 installed at a later date. Also, depending upon the diameter of the grout tube 3 and the protecting tube 1 there is the option of installing more than one grout injection tube 3 at different lengths to inject grout 5 at different elevations. Where mid-height grout injection tubes 3 are installed then additional ports 17 will need to be included in the sides of the protection tube unless the tube is removed prior to grouting. The outlet area around the injection end of the tube needs to include coarse grained fill 16 such as gravel to provide larger void space for the grout to flow through.

FIG. 2 Presents the initial stage of the construction of protective sand 2 around grout injection tubes 3, where a cloth wrap 11 is used to contain the protective sand 2, and the gravel. As shown the end of grout injection tube 3 is outlet through the end wall 12. The other end of the injection tube is at the end of the cloth wrap 11 where grout can be injected into the void space of the large fill items 4. The large fill items 4 may consist of gravel, cobble or boulder size rock, or even inert demolition debris such as concrete rubble and used bricks. The intent is to provide sufficient protective sand or other fine grained 2 material to act as a cushion to prevent damage from the large fill items 4 to any of the injection tube 3. Where more than one injection tube is used the mid distance injection tube 3 should be provided with coarse grained gravel size 16 material and outlet holes 18 in the cloth 11 cover.

FIG. 3 Presents the same view as FIG. 2 with sand 2 and cloth 1 lcover for two grout injection tubes 3, except the process has moved ahead to where most of the injection tubes are covered and the large fill items 4 are now being placed on top of the cloth cover 11. The mid length grout injection tube 3 now covered by cloth 11 which has grout outlet holes 18 showing just above the end of the short injection tube. At that point the tube 3 is indicated by a dashed line and sand 2 and large void gravel 16 are not shown in this view. This is also the case for the conditions near the end of the longer grout injection tube 3 at the end of the cloth cover 11. FIG. 3 indicates the location of the cut section that is presented on FIG. 4.

FIG. 4 This presents the cross section of the grout injection tube 3 and its protective cover system. At this point the pipe is underlain by the large fill items 4 and a leveling layer of rounded gravel size fill 13 all on top of the ground surface 15 and the underlying native material 14. The cloth 11 was laid on top of the rounded material and then sand 2 was placed above and below tube 3. The remainder of the cloth 11 was wrapped over the tube 3 and sand 2 before the remaining large fill items 4 are placed over the entire protective cover system.

PATENT DESCRIPTION

The following describes how to make and use the Grout Tube Protection System. There are two basic methods claimed and described herein. The first is a method that forms a drillable shaft within a debris or rock fill. The second is to lay a pipe horizontally or at an angle in a debris or rock fill as the large debris and/or rock is being placed to form a new fill. Where grout injection pipes are only used once due to the grout eventually filling and blocking the tube making it unusable for a second time, then it is desirable to use a lightweight expendable product. One of the primary concerns is installing and protecting the tubes until the operation has reached the point in the construction process for the grout to be injected into the fill. As shown in FIG. 1 the grout pipes 3 were drilled into the fill 4 formation after the debris and/or rock fill 4 had reached the point in the process that grout 5 needs to be injected. The primary problem with drilling into a loose debris or rock fill 4 is that the individual large pieces have a tendency to shift during or after drilling. The shifting of the debris or rocks will cause the hole to partially or completely close. This results in either binding on the drill rod or damaging the grout pipe prior to it being put in to use. The solution to this problem is to create a separate sand fill 2 deposit within the main debris or rock fill 4 at locations selected prior to placing any portion of the fill. As the fill is being placed the grout locations need a porous membrane 1 or metal tube to separate the sand fill 2 deposit from the debris rock fill 4 deposit. Once the main fill 4 has reached an elevation where grouting is desired then the sand fill 2 deposit can be drilled for the installation of grout tubes 3 to the desired elevations. If a rigid tube 1 such as a metal tube is used, then it will need to be extracted prior to grouting. FIG. 1 shows the ground or top surface 9 and in the case of a limited area the limit or edge 10 is also shown. As described in patent Ser. No. 18/181,542 gravel 16 should be placed within most of the void space between the larger fill 4. Only a minimal amount of gravel 16 is shown for clarity of the FIG. 1. Also shown is only one side opening 17 for simplicity but for any given situation the number of openings 17 should be based upon the volume of the zone to be grouted. The large material may make indentations 8 into the lining but as shown the size of the sand fill 2 should take this into account. Although only two grout pipes 3 and two locations for grout 5 to outlet are shown it should be understood that the number of pipes 3 and their outlet points would depend upon a number of factors which may require additional outlet points along the sides of grout tube 3.

FIGS. 2,3, and 4 show a sequence of construction of grout pipes 3 placed within a filter cloth 11 as the large debris and or rock fill 4 is being placed. The primary purposes of this patent are ONE to protect the grout pipes 3 within the fill 4 zone from being damaged prior to grouting and TWO to provide numerous paths for the grout 5 to pass out into all parts of the fill 4. In the FIG. 2 embodiment the fill 4 is being placed behind a wall 12. The grout pipes 3 pass through the wall 12 so that when the grout 5 is needed it can be pumped into the fill 4 from the opposite side of the wall 12. At this point the grout tube protection is in its beginning stage. The filter cloth 11 is laid out to make a bottom and the pipes 3 have been installed through wall 12 and placed on top of the cloth 11 along with gravel fill 16. For the grout 5 to pass beyond the cloth 11 the e not pass through the cloth 11 but the openings 18 are large enough to allow the grout 5 to pass through without any hinderance. Along with the gravel 16 the pipes are also placed on a bed of sand 2. FIG. 3 shows the same fill 4 being placed behind wall 12, with the same grout pipes 3 passing through the wall 12 and out into the fill 4. The FIG. 3 embodiment shows the progression of the protection system where the front portion of cloth 11 has been folded back over the sand 2, gravel 16 and the pipes 3. Then the back portion of the cloth 11 has been folded over the front and pinned down with the large debris and or rocks from the fill 4. With the final closing of the cloth 11 the filling of the site may continue. It should be noted that these figures show the construction of the system within the fill 4 area. However, it is possible to manufacture the protection system outside of the fill 4 area and then move it as a unit into the fill area with the pipes 3 or pipe connectors installed at the end of the wrap. FIG. 3 also shows a section cut for FIG. 4.

FIG. 4 shows the final stage where the grout 5 is flowing out of the sand 2, gravel 16, and cloth 11 wrap and into the void spaces between the large debris and or rock fill 4. This figure also shows the ground 14 and its surface 15 that the fill 4 is being placed upon. Also shown is where the grout 5 has solidified into solid material 20 in the voids between the large fill 4. When this grouting is complete, and all the voids are filled with solid grout 20 the entire fill mass will become one large mass with the desired properties that the project design requires.

The invention claimed is:

1. Method of injecting grout an above ground fill of loose soil, rocks and/or inert debris comprising:

placing a grout injection tube into said above ground fill;

said grout injection tube encased within a protective layer of sand and/or gravel;

said grout injection tube and said protective layer enclosed within a wrapping of a porous material to prevent the migration of said sand and/or gravel beyond the wrapping;

said grout injection tube, protective layer, and wrapping surrounded by said above ground fill;

injecting grout through said injection tube, said protective layer, and said wrapping into said above ground fill, thereby consolidating said soil, rock and/or inert debris.

2. The method of claim 1, wherein more than one grout injection tube is enclosed within the same protective layer and wrapping.

3. The method of claim 1, wherein said grout injection tube has openings in selected segments so that grout may be injected in different areas.

4. The method of claim 1, wherein said grout injection tube, said protective layer, and said wrapping are assembled in the place of said above ground fill.

5. The method of claim 1, wherein said grout injection tube, said protective layer, and said wrapping are assembled away from the above ground fill and transported to the place of said above ground fill prior to use.

6. The method of claim 1, wherein a delivery tube is connected to said injection grout tube.

7. The method of claim 1, wherein said placing includes positioning said grout tube, said protective layer, and said wrapping vertically, horizontally, or at any angle as needed.

8. A consolidated above ground fill of soil, rock, and/or inert debris comprising: a grout injection tube in said above ground fill;

Said grout injection tube enclosed within a protective layer of sand and/or gravel;

said grout injection tube and said protective layer enclosed within a wrapping of a porous material to prevent the migration of said sand and/or gravel beyond the wrapping;

said grout injection tube, protective layer, and wrapping surrounded by said above ground fill;

grout which has been injected through said grout injection tube, said protective layer, and said wrapping into said above ground fill.

9. The consolidated above ground fill of claim 8, wherein more than one grout injection tube is enclosed within the same protective layer and wrapping.

10. The consolidated above ground fill of claim 8, wherein said grout injection tube has openings in selected segments and grout has been injected to different areas.

* * * * *